US008753235B1

(12) United States Patent
Daniel et al.

(10) Patent No.: US 8,753,235 B1
(45) Date of Patent: Jun. 17, 2014

(54) BALL WITH REMOVABLE BLADDER

(75) Inventors: Isaac Sayo Daniel, Miramar, FL (US); Alberto Interian, III, Miramar, FL (US); Basel Hasan Saleh, Miramar, FL (US)

(73) Assignee: F3M3 Companies, Inc.

( * ) Notice: Subject to any disclaimer, the term of this patent is extended or adjusted under 35 U.S.C. 154(b) by 76 days.

(21) Appl. No.: 12/830,088

(22) Filed: Jul. 2, 2010

(51) Int. Cl.
*A63B 39/00* (2006.01)

(52) U.S. Cl.
USPC ..... 473/603

(58) Field of Classification Search
USPC ..... 473/413, 569, 593–603
See application file for complete search history.

(56) References Cited

U.S. PATENT DOCUMENTS

| | | | | |
|---|---|---|---|---|
| 1,972,909 | A * | 9/1934 | Turner | 473/603 |
| 2,625,398 | A * | 1/1953 | Robinson et al. | 473/603 |
| 2,761,684 | A * | 9/1956 | Crowley et al. | 473/605 |
| 4,248,424 | A * | 2/1981 | Judkins | 473/613 |
| 6,402,647 | B1 * | 6/2002 | Haseltine | 473/605 |
| 6,514,164 | B1 * | 2/2003 | Parrett | 473/603 |
| 6,572,499 | B2 * | 6/2003 | Davies | 473/604 |
| 2008/0064541 | A1 * | 3/2008 | Spector | 473/604 |

* cited by examiner

*Primary Examiner* — Gene Kim
*Assistant Examiner* — Amir Klayman
(74) *Attorney, Agent, or Firm* — Isaac Daniel Group, Inc.

(57) ABSTRACT

A ball kit comprising at least one shell and at least one removable bladder operative to be insertable into the at least one shell. A ball kit comprising at least one shell having at least one aperture and a plurality of removable bladders. A ball comprising a shell and a removable bladder positioned within the shell. A method of using a ball, comprising placing a removable bladder within a shell and inflating the removable bladder within the shell.

27 Claims, 6 Drawing Sheets

BALL WITH REMOVABLE BLADDER

FIELD

The present disclosure relates generally to sports and game apparatuses, and more particularly, to apparatuses and systems related to balls.

BACKGROUND

Balls have been used throughout the ages for many purposes, but perhaps no purpose has been more popular than recreation, such as sports. Many sports include the use of balls, such as, but not limited to, football, soccer, volleyball, water polo, golf, baseball, basketball, pool, tennis, racquetball, rugby, and the like.

The balls that are used in these sports, especially at the professional level, must conform to strict specifications, which include size, weight, shape, texture, and durability. In most cases, however, players, especially novices, do not benefit by training with balls that adhere to professional level specifications, since their skills are usually not honed enough to manipulate the balls effectively. Accordingly, many players use training balls to train for various sports, including soccer.

Traditionally, training balls have had specifications that differ from actual game balls, such as different weights, sizes, shapes, surface textures, and the like. In some instances, such as soccer, external equipment, such as a leash, has been included to make training easier. In soccer, for example, a desirable skill a player often trains to obtain is the ability to dribble the ball well. Learning to dribble a soccer ball well can be difficult to learn, since controlling a soccer ball with one's feet can be difficult, especially when the weight of a soccer ball is either too heavy or too light for a user, or the surface texture is too slippery.

Traditionally, soccer balls used for training have included only a leash connected to the ball, which can be worn by the user, and which allows the user to practice dribbling the ball while maintaining control of the ball via the leash. Furthermore, traditional training balls have been non-configurable, thus denying the player the ability to incrementally increase or decrease the difficulty of the training by changing certain characteristics of the training ball. Therefore most training balls can be cumbersome to use, such as in the case of a soccer ball leash, and do not effectively develop a player's skills since they do not allow the player to practice without equipment such as a leash, and they do not offer the player the ability to customize the specification of the training ball, which would provide incremental stages of difficulty to help the player develop his or her skills.

SUMMARY

The various kits, balls, devices, systems, methods, and other disclosures described herein result from the realization that training for a sport can be made more effective by providing and using a kit or a ball that comprises at least one shell, such as a ball shell, and at least one removable bladder operative to be insertable into the at least one shell.

Accordingly, the various embodiments and disclosures described herein solve the limitations of the prior art in a new and novel manner.

DETAILED DESCRIPTION OF PREFERRED EMBODIMENTS

Figure 1A:
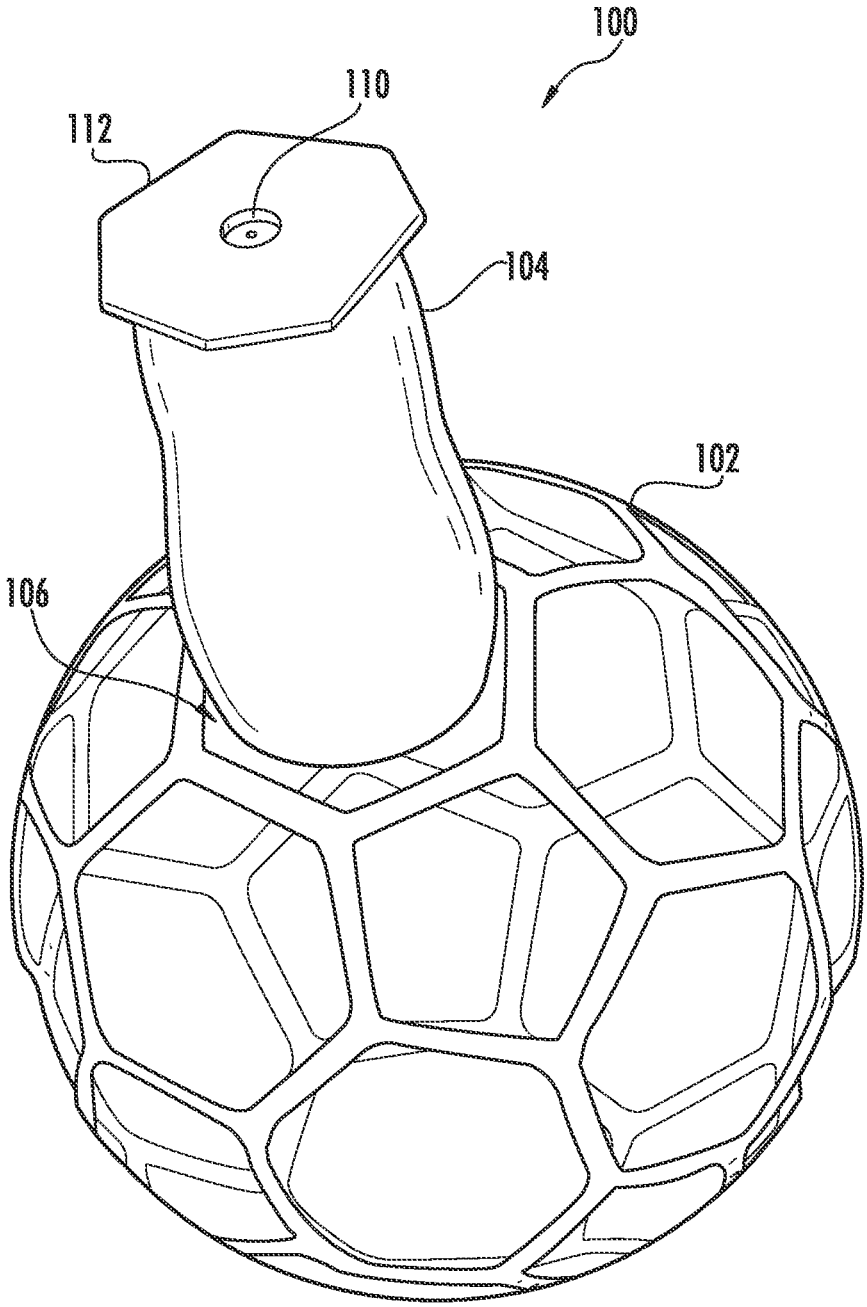
FIGS. 1A through 1C show a ball kit in accordance with various embodiments.

Referring now to FIG. 1A, an embodiment of a ball kit 100 is shown, wherein ball kit 100 comprises of at least one shell 102, and at least one removable bladder 104 operative to be insertable into at least one shell 104.

In some embodiments, at least one shell 102 may include at least one aperture 106 and may be operative to receive at least one removable bladder 104 through at least one aperture 106. In another embodiment, at least one shell 102 may include a plurality of apertures.

In some embodiments, at least one shell 102 may be made of any material, such as a rigid material, such as, but not limited to plastic, wood, straw, wicker, metal, Kevlar, polycarbonate, thermoplastics, and the like, or a flexible material, such as, but not limited to, rubber, latex, and the like.

In another embodiment, at least one shell 102 may be any kind of shell or may be in any kind of shape or size. In yet another embodiment, at least one shell 102 may be at type of shell selected from the group consisting essentially of a soccer ball shell, a football shell, a rugby ball shell, a basketball shell, a baseball shell, a volleyball shell, and a water polo ball shell. In yet another embodiment, at least one shell 102 may be a ball frame, such as, but not limited to, an external frame, a wireframe, and the like.

In some embodiments, at least one removable bladder 104 may be an inflatable bladder. In one embodiment, at least one removable bladder 104 may be formed of a non-stretch material, such as, but not limited to, plastic, Kevlar, and the like. In yet another embodiment, at least one removable bladder 104 may be formed of stretchable material, such as, but not limited to, rubber and the like. In yet a further embodiment, at least one removable bladder 104 may be of any shape or size, such as in the shape or size of a soccer ball, football, rugby ball, basketball, baseball, volleyball, golf ball, water polo ball, and the like. In yet another embodiment, at least one removable bladder 104 may be of a similar shape and/or size as at least one shell 102.

Figure 1B:
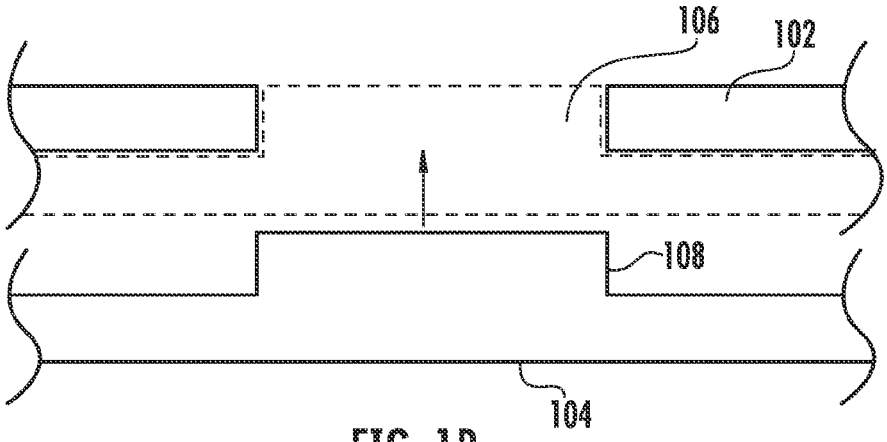

In one embodiment, at least one removable bladder 104 may include surface elevations and/or depressions (shown as 108 shown in FIG. 1B) that may be of a similar shape and size of at least one aperture 106 or at least one shell 102, and, upon inflation, may fill in at least one aperture 106 or a plurality of apertures in at least one shell 102. In some embodiments, when at least one removable bladder 104 fills in at least one aperture 106, an even surface may be formed along the interface between at least one shell 102 and at least one removable bladder 104.

In yet another embodiment, at least one removable bladder 104 may comprise a surface texture, wherein the surface texture may be any kind of surface texture, such as, but not limited to, a smooth surface texture, a sticky surface texture, a rough surface texture, a grippy surface texture (i.e. a surface texture that tends to grip well), and the like.

In another embodiment, ball kit 100 comprises a plurality of removable bladders, wherein at least one of and/or each of the plurality of removable bladders comprises a different weight and is operative to be insertable into at least one shell 102. In one embodiment, at least one of and/or each of the plurality of removable bladders may be formed of a different material, wherein said materials may have different densities. In another embodiment, at least one of and/or each of the plurality of removable bladders may have different bladder thicknesses. In yet another embodiment, at least one of and/or each of the plurality of removable bladders may have different surface textures, such as surface textures that differ in degrees of grip, roughness, smoothness, and the like.

In another embodiment, ball kit 100 further comprises at least one means 110 for inflating at least one removable bladder 104. In some embodiments, at least one means 110 may comprise a valve, such as, but not limited to, a Schrader valve, a presta valve, a standard sports balls inflation valves, and the like. In yet another embodiment, at least one means 110 may comprise a pump, such as a man-powered pump, which may include, but is not limited to, a hand pump, a foot pump and the like, or an electric pump. In yet another embodiment, at least one means 110 may be connected or integrated with at least one removable bladder 104.

In yet another embodiment, ball kit 100 further comprises at least one means 112 for securing at least one removable bladder 104 to at least one shell 102. In some embodiments, at least one means 112 may comprise a rigid object, such as a plate or cap, which may removably interlock with at least one aperture 106 in at least one shell 102. In such embodiments, at least one means 112 may be screwed into, clipped into, or pressed into at least one aperture 106. In some embodiments, at least one means 112 may comprise a magnet, a screw in cap or plate, a clip, a zipper, a button, or any other means for securing at least one removable bladder 104 to at least one shell 102. In yet another embodiment, at least one means 112 for securing at least one removable bladder 104 to at least one shell 112 may be connected to and/or integrated with at least one means 110 for inflating at least one removable bladder 104.

Figure 1C:
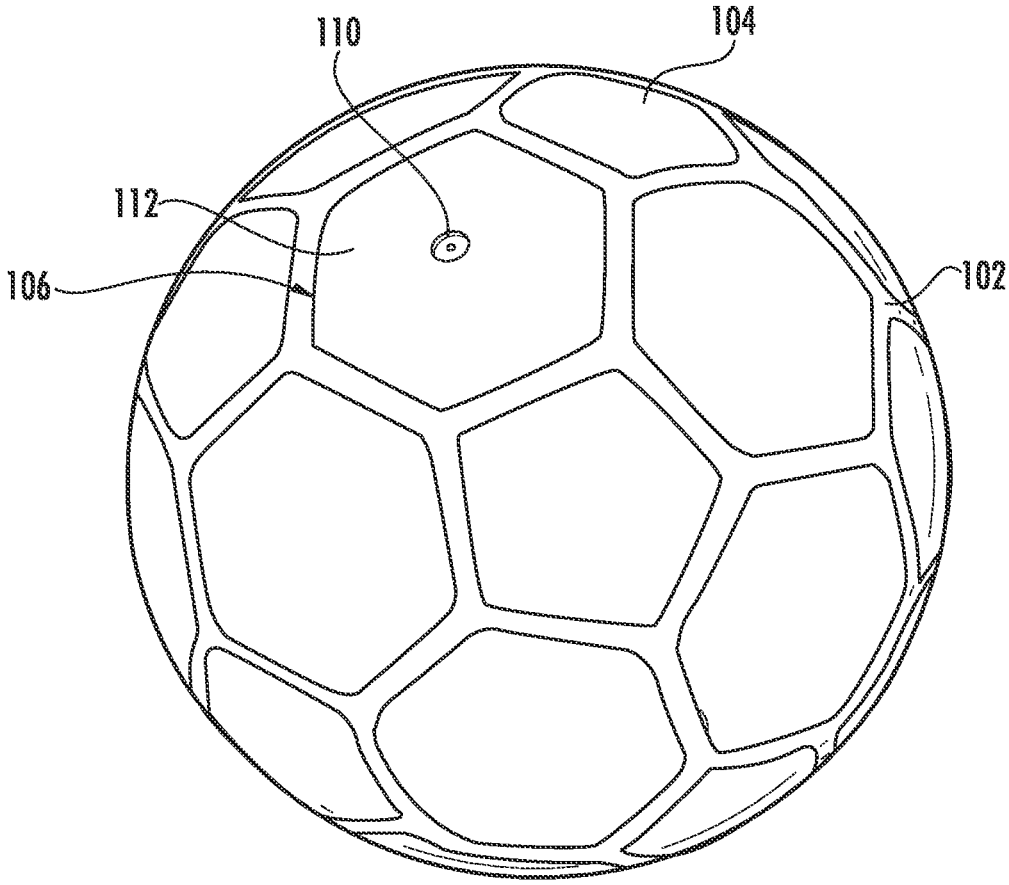

In yet another embodiment, when at least one removable bladder 104 is inflated within at least one shell 102, it secures itself to at least one shell 102 (as shown in FIG. 1C). In some embodiments, this may be due to the tight fit between at least one removable bladder 104 and at least one shell 102.

In a further embodiment, ball kit 100 comprises a plurality of shells, wherein at least one of and/or each of the plurality of shells comprises a different weight and is operative to receive at least one removable bladder 104. In one embodiment, at least one of and/or each of the plurality of shells may be formed of a different material, wherein said materials may have different densities. In another embodiment, at least one of and/or each of the plurality of shells may have different shell thicknesses. In yet another embodiment, at least one of and/or each of the plurality of shells may have different surface textures, such as surface textures that differ in degrees of grip, roughness, smoothness, and the like.

Figure 2:
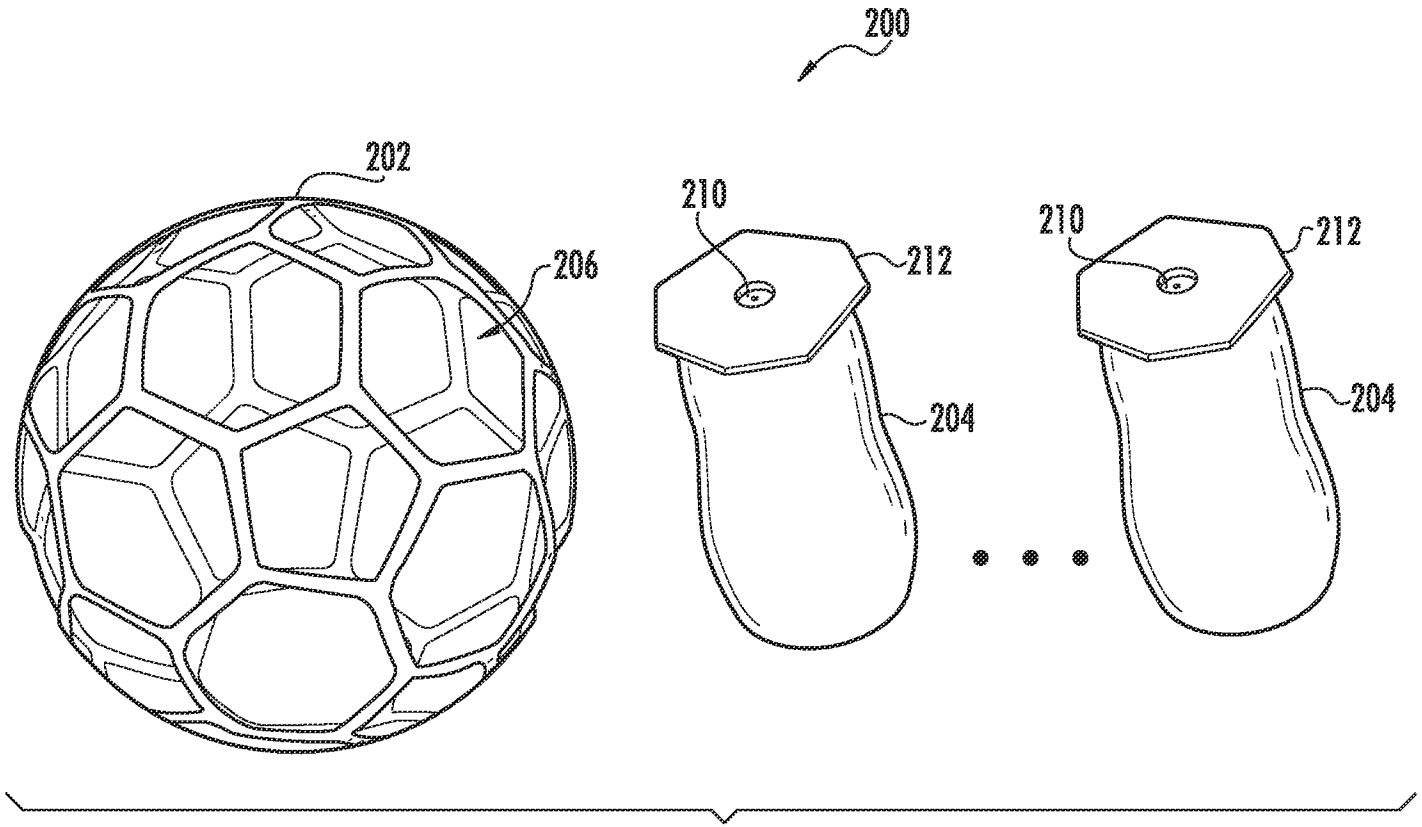
FIG. 2 shows a ball kit in accordance with one embodiment.

Referring now to FIG. 2, a ball kit 200 is shown in accordance with one embodiment, wherein ball kit 200 comprises at least one shell 202, and a plurality of removable bladders 204. In some embodiments, at least one shell 202 may include at least one aperture 206 and may be operative to receive at least one of the plurality of removable bladders 204 through at least one aperture 206. In another embodiment, at least one shell 202 may include a plurality of apertures.

In some embodiments, at least one shell 202 may be made of any material, such as a rigid material, such as, but not limited to plastic, metal, wicker, wood, straw, Kevlar, polycarbonate, thermoplastics, and the like, or a flexible material, such as, but not limited to, rubber, latex, and the like.

In another embodiment, at least one shell 202 may be any kind of shell or may be in any kind of shape or size. In yet another embodiment, at least one shell 202 may be at type of shell selected from the group consisting essentially of a soccer ball shell, a football shell, a rugby ball shell, a basketball shell, a baseball shell, a volleyball shell, and a water polo ball shell. In yet another embodiment, at least one shell 202 may be a ball frame, such as, but not limited to, an external frame, a wireframe, and the like.

In some embodiments, at least one of the plurality of removable bladders 204 may be an inflatable bladder. In one embodiment, at least one of the plurality of removable bladders 204 may be formed of a non-stretch material, such as, but not limited to, plastic, Kevlar, and the like. In yet another embodiment, at least one of the plurality of removable bladders 204 may be formed of stretchable material, such as, but not limited to, rubber and the like. In yet a further embodiment, at least one of the plurality of removable bladders 204 may be of any shape or size, such as in the shape or size of a soccer ball, football, rugby ball, basketball, baseball, volleyball, golf ball, water polo ball, and the like. In yet another embodiment, at least one of the plurality of removable bladders 204 may be of a similar shape and/or size as at least one shell 102.

In one embodiment, at least one of the plurality of removable bladders 204 may include surface elevations and/or depressions (of which an example is shown as 108 shown in FIG. 1B) that may be of a similar shape and size of at least one aperture 206 or at least one shell 202, and, upon inflation, may fill in at least one aperture 206 or a plurality of apertures in at least one shell 202. In some embodiments, when at least one of the plurality of removable bladders 204 fills in at least one aperture 206, an even surface may be formed along the interface between at least one shell 202 and at least one of the plurality of removable bladders 204.

In yet another embodiment, at least one of the plurality of removable bladders 204 may comprise a surface texture, wherein the surface texture may be any kind of surface texture, such as, but not limited to, a smooth surface texture, a sticky surface texture, a rough surface texture, a grippy surface texture (i.e. a surface texture that tends to grip well), and the like.

In another embodiment, at least one of and/or each of the plurality of removable bladders 204 comprises a different weight and is operative to be insertable into at least one shell 202. In one embodiment, at least one of and/or each of the plurality of removable bladders 204 may be formed of a different material, wherein said materials may have different densities. In another embodiment, at least one of and/or each of the plurality of removable bladders 204 may have different bladder thicknesses. In yet another embodiment, at least one of and/or each of the plurality of removable bladders 204 may have different surface textures, such as surface textures that differ in degrees of grip, roughness, smoothness, and the like.

In another embodiment, ball kit 200 further comprises at least one means 210 for inflating at least one of the plurality of removable bladders 204. In some embodiments, at least one means 210 may comprise a valve, such as, but not limited to, a Schrader valve, a presta valve, a standard sports balls inflation valves, and the like. In yet another embodiment, at least one means 210 may comprise a pump, such as a man-powered pump, which may include, but is not limited to, a hand pump, a foot pump and the like, or an electric pump. In yet another embodiment, at least one means 210 may be connected or integrated with at least one of the plurality of removable bladders 204.

In yet another embodiment, ball kit 200 further comprises at least one means 212 for securing at least one of the plurality of removable bladders 204 to at least one shell 202. In some embodiments, at least one means 212 may comprise a rigid object, such as a plate or cap, which may removably interlock with at least one aperture 206 in at least one shell 202. In such embodiments, at least one means 212 may be screwed into, clipped into, or pressed into at least one aperture 206. In some embodiments, at least one means 212 may comprise a magnet, a screw in cap or plate, a clip, a zipper, a button, or any other means for securing at least one of the plurality of removable bladders 204 to at least one shell 202. In yet another embodiment, at least one means 212 for securing at least one of the plurality of removable bladders 204 to at least one shell 202 may be connected to and/or integrated with at least one means 210 for inflating at least one of the plurality of removable bladders 204.

In yet another embodiment, when at least one of the plurality of removable bladders 204 is inflated within at least one shell 202, it secures itself to at least one shell 202 (as shown, for example, in FIG. 1C). In some embodiments, this may be due to the tight fit between at least one of the plurality of removable bladders 204 and at least one shell 202.

In a further embodiment, ball kit 200 comprises a plurality of shells, wherein at least one of and/or each of the plurality of shells comprises a different weight and is operative to receive at least one of the plurality of removable bladders 204. In one embodiment, at least one of and/or each of the plurality of shells may be formed of a different material, wherein said materials may have different densities. In another embodiment, at least one of and/or each of the plurality of shells may have different shell thicknesses. In yet another embodiment, at least one of and/or each of the plurality of shells may have different surface textures, such as surface textures that differ in degrees of grip, roughness, smoothness, and the like.

Figure 3:
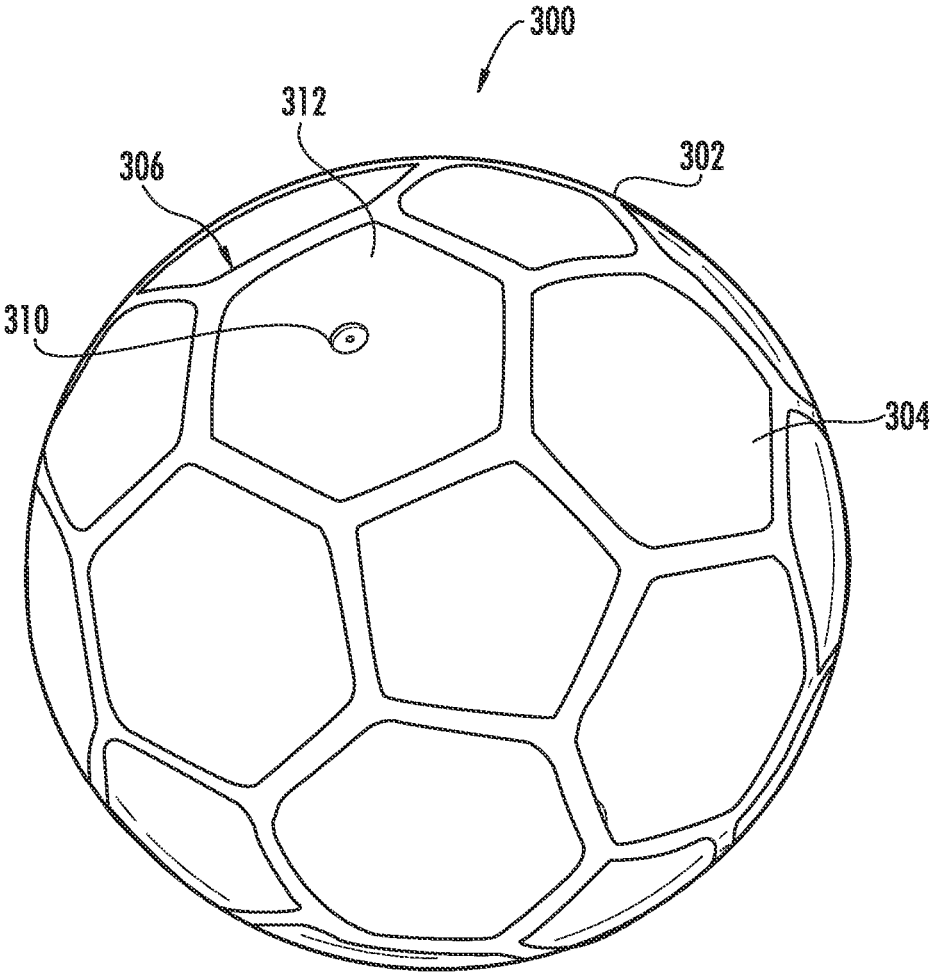
FIG. 3 shows a ball in accordance with one embodiment.

Referring now to FIG. 3, an embodiment of a ball 300 is shown, wherein ball 300 comprises a shell 302 and a removable bladder 304 positioned within shell 302.

In some embodiments, shell 302 may include at least one aperture 306 and may be operative to receive removable bladder 304 through at least one aperture 306. In another embodiment, shell 302 may include a plurality of apertures.

In some embodiments, shell 302 may be made of any material, such as a rigid material, such as, but not limited to plastic, metal, wood, wicker, straw, Kevlar, polycarbonate, thermoplastics, and the like, or a flexible material, such as, but not limited to, rubber, latex, and the like.

In another embodiment, shell 302 may be any kind of shell or may be in any kind of shape or size. In yet another embodiment, shell 302 may be at type of shell selected from the group consisting essentially of a soccer ball shell, a football shell, a rugby ball shell, a basketball shell, a baseball shell, a volleyball shell, and a water polo ball shell. In yet another embodiment, shell 302 may be a ball frame, such as, but not limited to, an external frame, a wireframe, and the like.

In some embodiments, removable bladder 304 may be an inflatable bladder. In one embodiment, removable bladder 304 may be formed of a non-stretch material, such as, but not limited to, plastic, Kevlar, and the like. In yet another embodiment, removable bladder 304 may be formed of stretchable material, such as, but not limited to, rubber and the like. In yet a further embodiment, removable bladder 304 may be of any shape or size, such as in the shape or size of a soccer ball, football, rugby ball, basketball, baseball, volleyball, golf ball, water polo ball, and the like. In yet another embodiment, removable bladder 304 may be of a similar shape and/or size as 302.

In one embodiment, removable bladder 304 may include surface elevations and/or depressions (of which an example is shown as 108 shown in FIG. 1B) that may be of a similar shape and size of at least one aperture 306 or shell 302, and, upon inflation, may fill in at least one aperture 306 or a plurality of apertures in shell 302. In some embodiments, when removable bladder 304 fills in at least one aperture 306, an even surface may be formed along the interface between shell 302 and removable bladder 304.

In yet another embodiment, removable bladder 304 may comprise a surface texture, wherein the surface texture may be any kind of surface texture, such as, but not limited to, a smooth surface texture, a sticky surface texture, a rough surface texture, a grippy surface texture (i.e. a surface texture that tends to grip well), and the like.

In another embodiment, ball 300 further comprises at least one means 310 for inflating removable bladder 304. In some embodiments, at least one means 310 may comprise a valve, such as, but not limited to, a Schrader valve, a presta valve, a standard sports balls inflation valves, and the like. In yet another embodiment, at least one means 310 may comprise a pump, such as a man-powered pump, which may include, but is not limited to, a hand pump, a foot pump and the like, or an electric pump. In yet another embodiment, at least one means 310 may be connected or integrated with removable bladder 304.

In yet another embodiment, ball 300 further comprises at least one means 312 for securing removable bladder 304 to shell 302. In some embodiments, at least one means 312 may comprise a rigid object, such as a plate or cap, which may removably interlock with at least one aperture 306 in shell 302. In such embodiments, at least one means 312 may be screwed into, clipped into, or pressed into at least one aperture 306. In some embodiments, at least one means 312 may comprise a magnet, a screw in cap or plate, a clip, a zipper, a button, or any other means for securing removable bladder 304 to shell 302. In yet another embodiment, at least one means 312 for securing removable bladder 304 to shell 302 may be connected to and/or integrated with at least one means 310 for inflating removable bladder 304.

In yet another embodiment, when removable bladder 304 is inflated within shell 302, it secures itself to shell 302 (as shown, for example, in FIG. 3). In some embodiments, this may be due to the tight fit between removable bladder 304 and shell 302.

Figure 4:
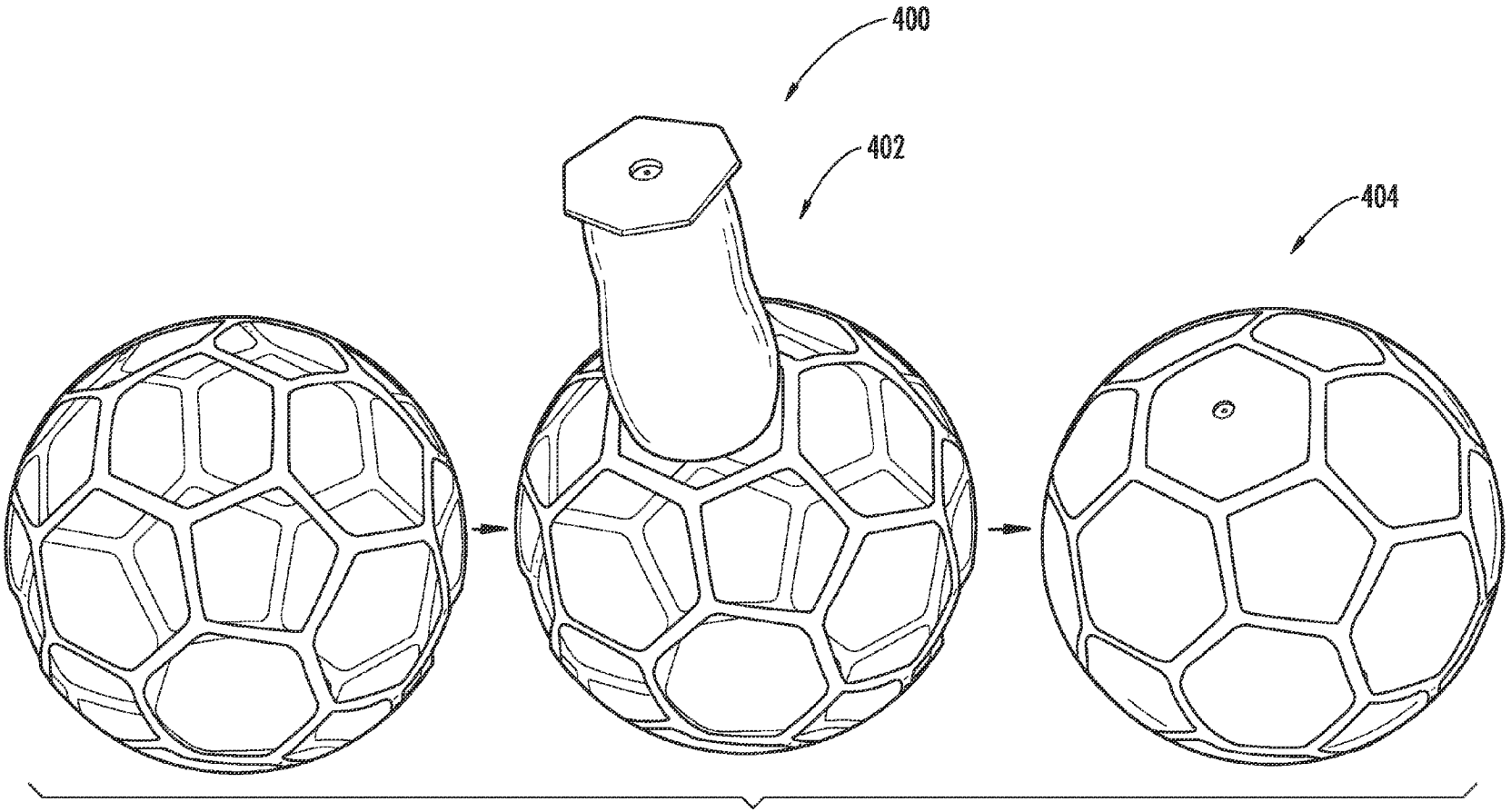
FIG. 4 shows a method of using a ball in accordance with one embodiment.

Referring now to FIG. 4, a method of using a ball 400 is shown, wherein method 400 comprises placing a removable bladder within a shell (step 402), and inflating the removable bladder within the shell 404.

In some embodiments, the shell and removable bladder may be any of those embodiments of shells and removable bladders and kits relating thereto described throughout the present disclosure.

In one embodiment, method 400 may further comprise removing the removable bladder from the shell, and placing a second removable bladder within the shell. In some embodiments, the second removable bladder may have a different weight than the removable bladder that was previously within the shell.

In some embodiments, placing a removable bladder within the shell comprises placing the removable bladder within the shell through at least one aperture.

In a further embodiment, method 400 comprises using at least one means of securing a removable bladder to the shell to secure the removable bladder to the shell.

In yet another embodiment, method 400 may comprise inflating the removable bladder within the shell to secure the removable bladder to the shell.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A ball kit comprising:

a. at least one shell having a plurality of apertures; and b. at least one removable bladder comprising a plurality of surface elevations, wherein one or more of the plurality of surface elevations each comprises a shape similar to a corresponding aperture in the at least one shell, wherein the at least one removable bladder is operative to be:

i. inserted into the at least one shell through at least one of the plurality of apertures in the at least one shell; and ii. inflated inside the at least one shell, wherein one or more of the plurality of surface elevations each fill a corresponding aperture in the at least one shell.

2. The ball kit of claim 1, wherein the surface of the at least one ball comprises an outer surface of the at least one removable bladder.

3. The ball kit of claim 1, wherein the surface of the at least one ball comprises an outer surface of one or more of the plurality of surface elevations.

4. The ball kit of claim 1, wherein the at least one removable bladder is formed of a single piece, or the at least one shell is formed of a single piece.

5. The ball kit of claim 1, further comprising a plurality of removable bladders, wherein at least one of or each one of the plurality of removable bladders comprises a different weight, size, or surface texture and is operative to be insertable into the at least one shell.

6. The ball kit of claim 1, further comprising at least one valve for inflating the at least one removable bladder, wherein the at least one valve is connected to the at least one removable bladder, and the at least one valve remains exposed through at least one of the plurality of apertures in the at least one shell when the at least one removable bladder is inflated inside the at least one shell.

7. The ball kit of claim 1, further comprising at least one means for securing the at least one removable bladder to the at least one shell.

8. The ball kit of claim 1, wherein the at least one removable bladder is secured to the at least one shell when one or more of the plurality of surface elevations in the at least one removable bladder fill one or more of the plurality of apertures in the at least one shell.

9. The ball kit of claim 1, further comprising a plurality of shells, wherein at least one of or each one of the plurality of shells comprises a different surface texture, size, or weight.

10. A ball kit comprising:

a. at least one shell having a plurality of apertures; and b. a plurality of removable bladders, wherein at least one of or each of the plurality of removable bladders comprises a plurality of surface elevations, wherein one or more of the plurality of surface elevations each comprises a shape similar to a corresponding aperture in the at least one shell, wherein at least one of the plurality removable bladders is operative to be inserted into the at least one shell through at least one of the plurality of apertures in the at least one shell, and inflated inside the at least one shell, and wherein one or more of the plurality of surface elevations each fill a corresponding aperture in the at least one shell.

11. The ball kit of claim 10, wherein at least one of or each one of the plurality of removable bladders comprises a different weight, size, or surface texture and is operative to be insertable into the at least one shell through the at least one aperture.

12. The ball kit of claim 10, wherein at least one of or each of the plurality of removable bladders is formed of a single piece, or the at least one shell is formed of a single piece.

13. The ball kit of claim 10, wherein the surface of the at least one ball comprises an outer surface of one or more of the plurality of surface elevations.

14. The ball kit of claim 10, wherein the at least one shell comprises a wireframe structure.

15. The ball kit of claim 10, further comprising at least one means for securing at least one of or each of the plurality of removable bladders to the at least one shell.

16. The ball kit of claim 15, wherein the at least one means for securing at least one of or each of the plurality of removable bladders to the at least one shell is connected to at least one valve.

17. The ball kit of claim 10, further comprising a plurality of shells, wherein at least one of or each one of the plurality of shells comprises a different surface texture, size, or weight.

18. A ball comprising:

a. an outer shell having a plurality of apertures; and b. an inflatable removable bladder positioned within the outer shell, wherein the inflatable removable bladder comprises a plurality of surface elevations, wherein one or more of the plurality of surface elevations each comprises a shape similar to a corresponding aperture in the at least one outer shell, wherein one or more of the plurality of surface elevations each fill a corresponding aperture in the at least one outer shell and wherein the inflatable removable bladder is operative to be removed through at least one of the plurality of apertures.

19. The ball of claim 18, wherein the inflatable removable bladder is formed of a single piece or the outer shell is formed of a single piece.

20. The ball of claim 18, wherein the surface of the at least one ball comprises an outer surface of one or more of the plurality of surface elevations.

21. A method of using a ball, comprising:

a. inserting a first removable bladder into a shell through at least one of a plurality of apertures in the shell, wherein the first removable bladder comprises a plurality of surface elevations, wherein one or more of the plurality of surface elevations each comprises a shape similar to a corresponding aperture in the shell; and b. inflating the first removable bladder within the shell, wherein one or more of the plurality of surface elevations each fill a corresponding aperture in the shell when the first removable bladder is inflated within the shell, thereby forming a surface of the ball.

22. The method of using a ball of claim 21, further comprising:

a. removing the first removable bladder from the shell; and b. inserting a second removable bladder into the shell.

23. The method of using a ball of claim 22, wherein the second removable bladder comprises a different weight, size, or surface texture from the first removable bladder.

24. The method of using a ball of claim 22, wherein removing the first removable bladder from the shell comprises deflating the first removable bladder and removing the first removable bladder through at least one of the plurality of apertures in the shell.

25. The method of using a ball of claim 21, further comprising using at least one means for securing the first removable bladder to the shell to secure the first removable bladder to the shell.

26. The method of using a ball of claim 21, further comprising using at least one means for securing the first removable bladder to the shell to secure the first removable bladder to the shell prior to inflating the first removable bladder inside the shell.

27. The method of using a ball of 21, further comprising aligning at least a portion of the surface of the first removable bladder with at least one of the plurality apertures in the shell.

* * * * *